US009818568B2

(12) United States Patent
Guillanton et al.

(10) Patent No.: US 9,818,568 B2
(45) Date of Patent: Nov. 14, 2017

(54) FUSE HOLDER

(71) Applicant: DELPHI INTERNATIONAL OPERATIONS LUXEMBOURG S.A.R.L., Bascharage (LU)

(72) Inventors: Erwan Guillanton, Epernon (FR); Aymeric Perot, Epernon (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

(21) Appl. No.: 15/105,001

(22) PCT Filed: Dec. 17, 2014

(86) PCT No.: PCT/EP2014/078322

§ 371 (c)(1),
(2) Date: Jun. 16, 2016

(87) PCT Pub. No.: WO2015/091703

PCT Pub. Date: Jun. 25, 2015

(65) Prior Publication Data

US 2016/0322187 A1 Nov. 3, 2016

(30) Foreign Application Priority Data

Dec. 19, 2013 (FR) ..... 13 63102

(51) Int. Cl.
*H01H 85/165* (2006.01)
*H01H 85/00* (2006.01)
(Continued)

(52) U.S. Cl.
CPC ..... *H01H 85/165* (2013.01); *H01H 85/0026* (2013.01); *H01H 85/201* (2013.01);
(Continued)

(58) Field of Classification Search
CPC ..... H01H 85/0026; H01H 85/201; H01H 85/165; H01H 85/24; H01H 85/547; H01H 85/203
(Continued)

(56) References Cited

U.S. PATENT DOCUMENTS 2,049,389 A 7/1936 Pestarini
2,375,472 A * 5/1945 Hollins ..... H01H 85/201 337/195
(Continued)

FOREIGN PATENT DOCUMENTS

FR 2791175 A1 9/2000
GB 193508 A 2/1923

*Primary Examiner* — Anatoly Vortman
(74) *Attorney, Agent, or Firm* — Robert J. Myers

(57) ABSTRACT

The invention relates to a fuse holder comprising two housing elements which, once assembled, together form a tube in which a support for a fuse is accommodated. Each of the two housing elements comprises a contact for establishing an electrical contact with a terminal of a fuse housed in the support, when the support is installed between the assembled housing elements. The support may comprise means to ensure the correct position of each contact in its respective housing element. The support may also comprise means to ensure the correct orientation of the fuse in the support. The support may also comprise means for retaining a seal ensuring sealing between the two housing elements.

8 Claims, 2 Drawing Sheets

(51) Int. Cl.
*H01H 85/20* (2006.01)
*H01H 85/24* (2006.01)
*H01H 85/54* (2006.01)

(52) U.S. Cl.
CPC ..... *H01H 85/24* (2013.01); *H01H 85/203* (2013.01); *H01H 85/547* (2013.01)

(58) Field of Classification Search
USPC ..... 337/213
See application file for complete search history.

(56) References Cited

U.S. PATENT DOCUMENTS 2,758,295 A * 8/1956 Sundt ..... H01H 85/32 337/206
3,243,551 A * 3/1966 Hollins ..... H01H 85/201 337/195
3,356,806 A * 12/1967 Urani ..... H01H 85/201 337/192
3,417,359 A * 12/1968 Urani ..... H01H 85/201 337/201
3,778,741 A * 12/1973 Schmidt, Jr. ..... H01H 85/201 337/201
3,828,291 A * 8/1974 Urani ..... H01H 85/542 200/296
4,178,061 A * 12/1979 Ahroni ..... H01H 85/545 337/196
4,333,701 A * 6/1982 Schick ..... H01H 85/201 439/410
4,390,225 A * 6/1983 Coyne ..... H01H 85/306 337/213
4,488,767 A * 12/1984 Lehman ..... H01H 85/24 337/213
4,504,815 A * 3/1985 Harwath ..... H01H 85/306 337/201
4,909,761 A * 3/1990 Muguira ..... H01H 85/201 337/201
4,989,761 A 2/1991 Ikeda
5,018,991 A * 5/1991 Katz ..... H01H 85/201 337/205
5,267,879 A * 12/1993 Oakley ..... H01H 85/542 439/620.28
5,648,749 A * 7/1997 Lin ..... H01H 85/201 337/192
5,888,098 A * 3/1999 Cheng ..... H01H 85/201 439/620.28
5,903,209 A * 5/1999 Stepniak ..... H01H 85/042 337/199
6,157,287 A * 12/2000 Douglass ..... H01H 85/203 337/159
6,459,558 B1 * 10/2002 Hashizawa ..... H01H 85/54 337/186
6,483,417 B1 * 11/2002 Guthrie ..... H01H 85/542 337/186
6,587,028 B2 * 7/2003 Mollet ..... H01H 85/32 337/186
7,019,612 B2 * 3/2006 Lin ..... H01H 85/547 337/194
8,454,390 B2 * 6/2013 Darr ..... H01H 85/202 337/201
2012/0289086 A1 * 11/2012 Jetton ..... H01H 85/0026 439/587
2016/0307720 A1 * 10/2016 Guillanton ..... H01H 85/0026

* cited by examiner

FUSE HOLDER

CROSS-REFERENCE TO RELATED APPLICATION

This application is a national stage application under 35 U.S.C. §371 of PCT Application Number PCT/EP2014/078322 having an international filing date of Dec. 17, 2014, which designated the United States, said PCT application claiming the benefit of priority under Article 8 of the Patent Cooperation Treaty to French Patent Application No. 1363102, having a filing date of Dec. 19, 2013, the entire disclosure of each of which are hereby incorporated herein by reference.

TECHNICAL FIELD OF THE INVENTION

The invention concerns the field of fuse holders, and notably fuse holders for automotive applications.

BACKGROUND OF THE INVENTION

In particular, fuse holders of this type can be used to protect charging circuits of electric vehicles. Such circuits can carry currents of 63 amperes at 250 volts, for example. With such currents, the risk of overheating or even of fires occurring has to be taken under consideration. In order to eliminate, or at least to limit, this type of risk, the charging circuits are equipped with fuses. These fuses are advantageously placed as far upstream as possible in the charging circuit, for example at the level of the charging socket, in order to protect the vehicle and any occupants.

Given the importance of the protection role of these fuses, improvements to these fuses in order to increase their efficacy and reliability are looked for.

BRIEF SUMMARY OF THE INVENTION

To this end, there is provided in accordance with the invention a fuse holder including two housing elements. For example, once assembled, these two housing elements form a tube closed at each of its ends. They then make it possible to accommodate a fuse. A plurality of fuses may be accommodated in parallel between two housing elements. Each fuse includes two connecting terminals. Each housing element includes a contact intended to make an electrical connection with one of these terminals. To be more precise, two contacts are provided for each fuse, each situated in a respective housing element. Each contact is then intended to make an electrical connection with one of the two connecting terminals of a fuse.

The fuse holder further includes a support in which one or more fuses can be accommodated. The fuse holder is positioned inside the two housing elements assembled together so that each terminal is electrically connected to a contact.

The support makes it possible to increase the accuracy of the positioning of a fuse in a fuse holder, notably vis a vis the electrical connection between contacts and terminals, to the benefit of the reliability of the function implemented by this fuse.

In order to facilitate the insertion and the positioning of a fuse in a support, the support may be mounted on one of the housing elements in a mobile and/or removable manner. In this case, the support can occupy an open position in which the fuse can be mounted in the support. The support is then moved from this open position to a closed position in which the support is at least partly inserted in the housing element on which it is mounted. During this movement of the support, the support is guided in a precise manner by guide means in that housing element. Each fuse terminal is therefore also guided precisely toward a contact of this housing element, so that in the closed position each contact of this housing element and a terminal of the fuse are engaged one in the other.

There may equally be provision for the support to be movable to its closed position only if the fuse is correctly oriented and positioned in its support. The overall size of the exterior envelope of the support fitted with an incorrectly positioned fuse being greater than that of the exterior envelope of the support in which each fuse is correctly positioned, a snug opening is provided in the housing element on which the support is mounted in a mobile manner. Accordingly, if a fuse is not correctly positioned in the support, the latter cannot be moved through this opening.

The orientation and the positioning of a fuse in its support must be particularly precise, notably, for example, if the contacts are female contacts each receiving a respective pin extending from a terminal of the fuse, or vice versa. Accordingly, if the pin has a rectangular section, the support may include a slot, also rectangular and essentially perpendicular to the axis of the pin. The pin can then be snugly inserted in this slot, in accordance with an orientation enabling alignment of the pin with the opening of the female contact to make possible, or at least to facilitate, the introduction of the pin into the female contact when the support is moved from its open position to its closed position and/or when the housing elements are moved toward each other with a view to closing them.

Retaining means retaining the fuse on the latter can contribute to precise positioning of the fuse in its support and consequently of the fuse in the fuse holder.

There may equally be provided a support with locking reinforcing means known as primary lock reinforcement means or terminal position assurance means. For example, these locking reinforcement means may include a tongue that can be engaged behind a contact (here "behind" does not mean relative to the direction of insertion of the contact into its housing in a housing element but rather relative to a face of the contact perpendicular to this insertion direction), or a contact tongue, if that contact is correctly positioned in the housing element in which it is mounted. In other words, if the locking reinforcement means cannot be engaged behind this contact, the support cannot be moved, or at least not moved all the way, from its open position to its closed position, thereby indicating to the operative that the contact is not correctly positioned in the housing element in which it is mounted.

The fuse holder may also include a seal to provide the seal between the two housing elements. In this case, the support may include a retaining element such as a lug retaining the seal on one of the housing elements when the other housing element is not assembled thereto. This feature makes it possible to ship the fuse holder with a support pre-mounted on a housing element and with a seal already in place on the latter, whereas the contacts, the cables and the fuse will not be mounted until a later stage.

The housing element on which the seal is mounted may have a rim overlying the seal to protect it when the housing elements are not assembled together, for example during transportation steps.

Other features and advantages of the invention will become apparent on reading the following detailed description and from the appended drawings.

DETAILED DESCRIPTION OF THE INVENTION

Figure 1:
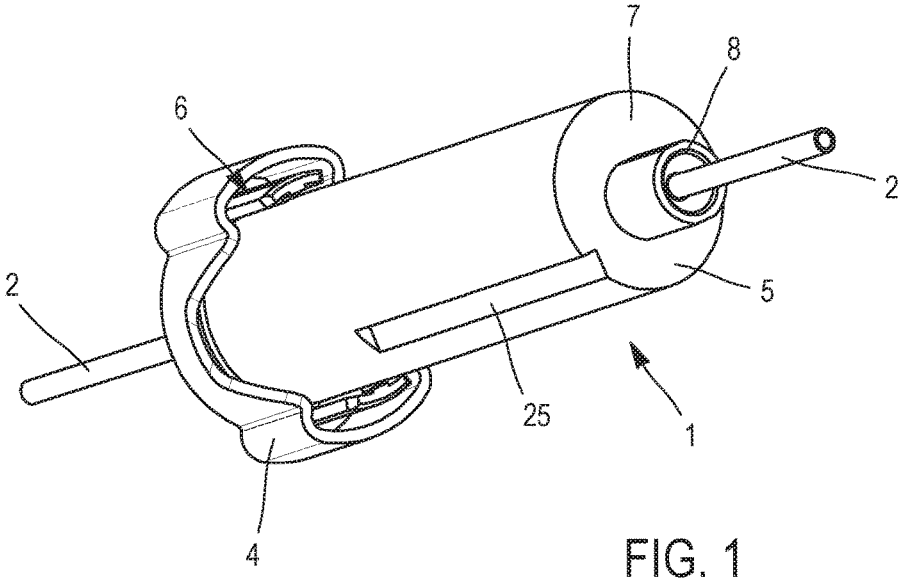
FIG. 1 represents diagrammatically in perspective one embodiment of a fuse holder in accordance with the invention.

One example of a fuse holder 1 is represented in FIG. 1. That fuse holder 1 is inserted between two cable portions 2, in an electrical circuit, such as a charging circuit of an electric vehicle. Each cable portion 2 is electrically connected, for example crimped or soldered, to a contact 3 (for example a Delphi female DCS1 contact 6.3 that can be seen in FIG. 5). Each contact is accommodated in a housing element 4, 5. A first housing element 4 includes locking means 6 for retaining a second housing element 5, forming a cover. Once assembled, the first and second housing elements form a tube closed at each of its ends by a wall 7 including a passage 8 for each cable portion 2.

Figure 2:
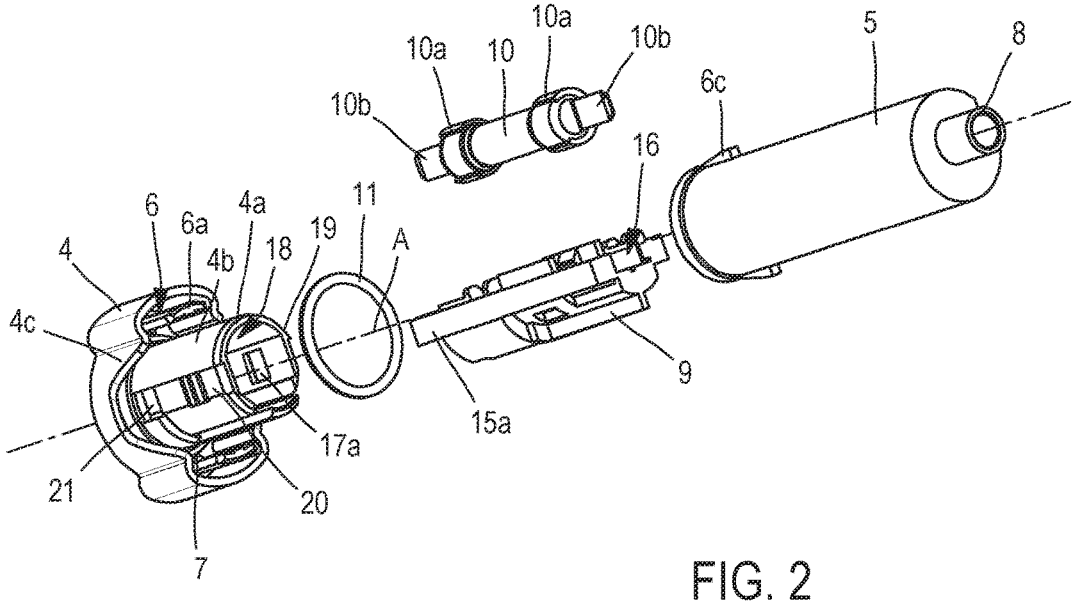
FIG. 2 represents diagrammatically in perspective an exploded view of the fuse holder from FIG. 1.

As represented in FIG. 2, this fuse holder includes, in addition to the contacts 3 and the first and second housing elements 4 and 5, a fuse support 9, a fuse 10 and a seal 11. The fuse 10 is accommodated in the support 9, itself accommodated in the tube consisting of the first housing element 4 and the second housing element 5 assembled together. The seal 11, mounted on the first housing element 4, is inserted between the first housing element 4 and the second housing element 5, in the manner of an interfacial seal, in order to provide the seal between them. Here the locking means 6 consist of two diametrically opposite elastic attachments 6*a* on the first housing element 4 each including a respective notch 6*b* (see FIGS. 4A and 4B) into which clips a lug 6*c* correspondingly situated on the second housing element 5. The first housing element 4 essentially consists of a substantially cylindrical cap 4*a* with an external face 4*b* partially surrounded by a skirt 4*c*.

The fuse 10 includes two terminals 10*a*, from each of which extends a pin 10*b* forming a male contact adapted to be electrically connected with a female type contact 3.

Figure 3A:
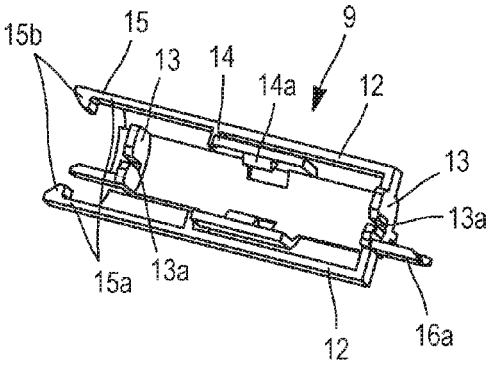
FIGS. 3A and 3B represent diagrammatically, in perspective, a support for the fuse holder from FIGS. 1 and 2, respectively without and with a fuse.
Figure 3B:
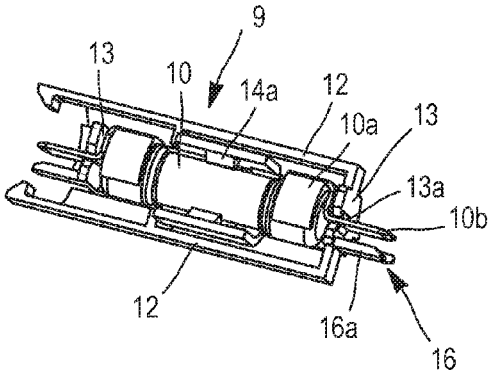

As represented in more detail in FIG. 3A, the support 9 is in the shape of a cradle with two side walls 12 extending longitudinally between two flanges 13. Two elastic lateral lugs 14 each extend from a respective side wall 12. Each of these lateral lugs 14 includes a detent 14*a* to form means for retaining a fuse 10 in its support 9, as shown in FIG. 3B.

The support 9 also includes guiding and fixing means 15 (FIG. 3A). These include two diametrically opposite lugs 15*a* each including a respective hook 15*b* intended to retain or to lock the support 9 onto the first housing element 4. These two lugs 15*a* constitute guide means that enable the support 9 to be guided and positioned precisely relative to the first housing element 4.

Each flange 13 includes a slot 13*a*. Each slot 13*a* is of essentially rectangular shape, open on an edge of the flange 13 oriented toward the top of the support 9. Each slot 13*a* is intended to receive a pin 10*b* of the fuse 10. Each pin 10*b* has an essentially rectangular cross section (i.e. a section perpendicular to the direction of insertion of the pin 10*b* into a contact 3, which also corresponds to the direction A of assembly of the first housing element 4 and the second housing element 5). Each pin 10*b* can then be snugly inserted in a respective slot 13*a*, as shown in FIG. 3B.

The support 9 also includes locking reinforcement means 16. These consist essentially of a tongue 16*a* extending longitudinally toward the exterior of the support 9 from each flange 13. The function of these tongues 16*a* is described in more detail later, with reference to FIG. 5.

Figure 4A:
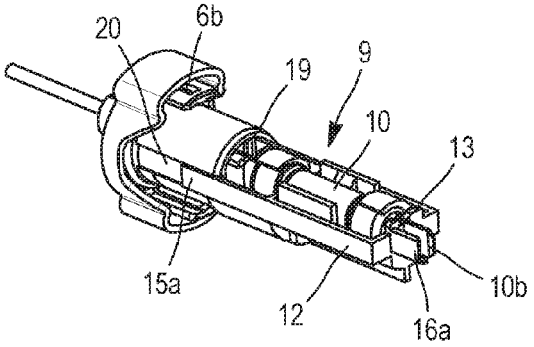
FIGS. 4A and 4B represent diagrammatically, in perspective, a support mounted on a housing element of the fuse holder from FIGS. 1 and 2, with the support respectively in the open position and in the closed position.
Figure 4B:
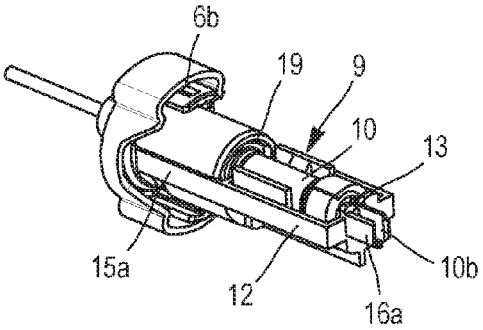

FIGS. 4A and 4B respectively show the open and closed positions of the support 9 on the first housing element 4. In the position corresponding to FIG. 4A, the support 9 is in an open or pre-locked position. In this position the fuse 10 can be introduced into the support 9 without having to demount the latter from the first housing element 4. The support 9 is retained, but mobile, on the first housing element 4 because the hooks 15*b* remain engaged in the posterior openings 17.

When the fuse 10 is correctly positioned between the lateral lugs 14, under the detents 14*a* and with the terminals 10*a* inserted in the slots 13*a*, the support 9 can be moved longitudinally, toward its closed position, inside a cavity 18 in the cap 4*a* of the first housing element 4 and leading to an opening 19. During this movement, the lugs 15*a* slide in diametrically opposite grooves 20 disposed longitudinally on the external face 4*b* of the cap 4*a*. Accordingly, on insertion of the support 9 into the first housing element 4, the latter is inevitably correctly oriented, so that the opening of the female contact 3, which is accommodated in the first housing element 4, is aligned with the corresponding pin 10*b*.

If the fuse 10 is not correctly positioned in the support 9, it projects from the external envelope which it should be inside. Its overall size is then such that it can no longer pass through the opening 19. Because of this, the support 9 cannot be moved into the closed position (that corresponding to FIG. 4B) and the second housing element 5 cannot be locked onto the first housing element 4. Thus the operative is alerted to incorrect mounting of the fuse 10. Otherwise, the support 9 can be moved to its closed position, in which the hooks 15*b* clip into anterior openings 21 (see FIG. 5).

The second housing element 5 can then be threaded onto the support 9 and around the cap 4*a*, to be locked by the locking means 6. As can be seen in FIG. 1 in particular, the second housing element 5 includes poka-yoke means 25 enabling an operative to orient it correctly relative to the support 9. Accordingly, upon its insertion onto the support 9, the second housing element 5 is inevitably correctly oriented, and so the opening of the female contact 3 that is accommodated therein is aligned with the corresponding pin 10*b*.

Figure 5:
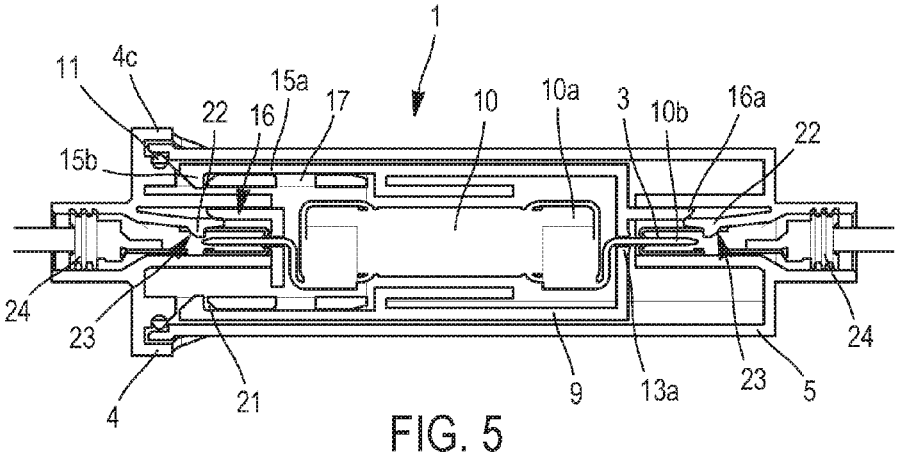
FIG. 5 represents diagrammatically in longitudinal section on an axial plane the fuse holder from FIGS. 1 and 2.

As shown in FIG. 5, the first housing element 4 and the second housing element 5 assembled in this way form a closed tube that is sealed by the interfacial seal 11 and the individual wire seals 24 crimped with the cable portions 2 onto the contacts 3.

If the contacts 3 are correctly inserted in their respective housings of the first housing element 4 and the second housing element 5, the locking tongues 22 spring into a cut-out 23 in the contacts 3 provided for this purpose. Accordingly, on inserting the support 9 in the first housing element 4, and on mounting the second housing element 5 on the already constituted assembly of the first housing element 4 and the support 9, the tongues 16*a* can be placed behind the contacts 3, and to be more precise behind the tongues 22. If on the other hand a contact 3 is not correctly inserted in its housing, the corresponding tongue 22 blocks the passage of a tongue 16*a* and either the support 9 cannot go to the closed position or the second housing element 5 cannot be fully locked onto the first housing element 4. In both cases the operative is alerted to a mounting error.

As can also be seen in FIG. 5, the seal 11 is protected by a rim consisting of the skirt 4*c*. The seal 11 is therefore protected even when the second housing element 5 is not assembled with the first housing element 4. Moreover, the lugs 15*a* are able to retain the seal 11 on the first housing element 4, under the skirt 4*c*, when the support 9 is in the closed position (which advantageously corresponds to the shipping position of the assembly consisting of the first housing element 4 and the support 9).

It can equally be seen in FIG. 5 that the second housing element 5 snugly surrounds the support 9 in which the fuse 10 is precisely accommodated, which fuse is itself connected to contacts 3 firmly and reliably locked in their respective housing thanks to the locking reinforcement means 16.

A fuse holder with a single support for a single fuse has been described above, but in accordance with variants the fuse holder in accordance with the invention may include either a single support but one that is able to accommodate a plurality of fuses or a plurality of supports each accommodating one or more fuses. All these variants may have one or more of the features defined in the claims.

The invention claimed is:

1. A fuse holder, comprising:

a first and second housing elements which, once assembled, accommodate a fuse, wherein the fuse includes two connecting terminals and wherein the first and second housing element each includes a contact that make an electrical connection with one of those terminals; and a support in which the fuse is accommodated in a position in which each of the terminals is electrically connected to the contact when the first and second housing elements are assembled together, wherein the support is mounted on the first housing element and is movable between an open position in which the fuse is mounted in the support and a closed position in which the contact of the first housing element and one terminal of the two connecting terminals of the fuse are engaged one in the other, wherein the contact is a female contact receiving a pin extending from the terminal of the fuse.

2. The fuse holder in accordance with claim 1, wherein the support is introduced into an opening of the first housing element in the closed position and wherein the support fitted with the fuse cannot be introduced into this opening if the fuse is not correctly positioned in the support.

3. The fuse holder in accordance with claim 1, wherein the pin has a rectangular cross section and the support includes a slot, also rectangular in cross section, in which the pin is snugly inserted, with an orientation making introduction of the pin into the female contact possible.

4. A fuse holder, comprising:

a first and second housing elements which, once assembled, accommodate a fuse, wherein the fuse includes two connecting terminals and wherein the first and second housing element each includes a contact that make an electrical connection with one of those terminals; and a support in which the fuse is accommodated in a position in which each of the terminals is electrically connected to the contact when the first and second housing elements are assembled together, wherein the support is mounted on the first housing element and is movable between an open position in which the fuse is mounted in the support and a closed position in which the contact of the first housing element and one terminal of the two connecting terminals of the fuse are engaged one in the other, wherein the support includes blocking reinforcement means that is engaged behind the contact if the contact is correctly positioned in the first or second housing element in which it is mounted and that cannot be engaged behind the contact if the contact is not correctly positioned in the first or second housing element in which it is mounted.

5. The fuse holder in accordance with claim 4, wherein the support is introduced into an opening of the first housing element in the closed position and wherein the support fitted with the fuse cannot be introduced into this opening if the fuse is not correctly positioned in the support.

6. A fuse holder, comprising:

a first and second housing elements which, once assembled, accommodate a fuse, wherein the fuse includes two connecting terminals and wherein the first and second housing element each includes a contact that make an electrical connection with one of those terminals;

a support in which the fuse is accommodated in a position in which each of the terminals is electrically connected to the contact when the first and second housing elements are assembled together, wherein the support is mounted on the first housing element and is movable between an open position in which the fuse is mounted in the support and a closed position in which the contact of the first housing element and one terminal of the two connecting terminals of the fuse are engaged one in the other; and a seal to provide the seal between the first and second housing elements, wherein the support includes a retaining element that retains the seal on the first housing element when the first and second housing elements are not assembled together.

7. The fuse holder in accordance with claim 6, wherein the first housing element on which the seal is mounted has a rim overlying the seal to protect it when the first and second housing elements are not assembled together.

8. The fuse holder in accordance with claim 6, wherein the support is introduced into an opening of the first housing element in the closed position and wherein the support fitted with the fuse cannot be introduced into this opening if the fuse is not correctly positioned in the support.

* * * * *